US009993867B2

(12) United States Patent
Tomita

(10) Patent No.: US 9,993,867 B2
(45) Date of Patent: Jun. 12, 2018

(54) HIGH-PRESSURE CASTING METHOD AND HIGH-PRESSURE CASTING DEVICE

(71) Applicant: FUKUI PREFECTURAL GOVERNMENT, Fukui-shi, Fukui (JP)

(72) Inventor: Koichi Tomita, Fukui (JP)

(73) Assignee: FUKUI PREFECTURAL GOVERNMENT, Fukui-shi (JP)

( * ) Notice: Subject to any disclaimer, the term of this patent is extended or adjusted under 35 U.S.C. 154(b) by 203 days.

(21) Appl. No.: 15/106,944

(22) PCT Filed: Jan. 5, 2015

(86) PCT No.: PCT/JP2015/050021
§ 371 (c)(1),
(2) Date: Jun. 21, 2016

(87) PCT Pub. No.: WO2015/105065
PCT Pub. Date: Jul. 16, 2015

(65) Prior Publication Data

US 2017/0036268 A1 Feb. 9, 2017

(30) Foreign Application Priority Data

Jan. 10, 2014 (JP) ..... 2014-002978

(51) Int. Cl.
*B22D 17/12* (2006.01)
*B22D 17/20* (2006.01)
(Continued)

(52) U.S. Cl.
CPC ..... *B22D 17/04* (2013.01); *B22D 17/12* (2013.01); *B22D 17/14* (2013.01); *B22D 17/203* (2013.01);
(Continued)

(58) Field of Classification Search
CPC ... B22D 17/12; B22D 17/2015; B22D 17/203
See application file for complete search history.

(56) References Cited

U.S. PATENT DOCUMENTS 5,865,237 A 2/1999 Schorghuber et al.
8,978,736 B2 * 3/2015 Stevick ..... B22D 17/203 164/113
2006/0254747 A1 * 11/2006 Ishida ..... B22D 17/12 164/312

FOREIGN PATENT DOCUMENTS

JP 10-29052 A 2/1998
JP 2006-281243 A 10/2006

OTHER PUBLICATIONS

International Search Report of PCT/JP2015/050021 dated Apr. 7, 2015 [PCT/ISA/210].

* cited by examiner

*Primary Examiner* — Kevin E Yoon
(74) *Attorney, Agent, or Firm* — Sughrue Mion, PLLC

(57) ABSTRACT

Provided is a high-pressure casting method and a high-pressure casting device which are capable of safe and high-quality casting of a high-fusion-point metal having a fusion point exceeding 1000 K. After melting a casting material (1) inside a melting container (2) of cartridge type, the melting container (2) is linearly moved to pass through a guide (14) attached to a casting port bush (13) to thereby be communicated with the casting port bush (13). The melting container (2) is brought into close contact with the guide (14) and is setting to a cooling state. After the elapse of prescribed time, a plunger (50) is brought into contact with a plunger tip (4), and is immediately transferred together with a molten metal to the casting port bush (13). The molten metal is pressurized inside the casting port bush (13), and is injection-filled into a cavity (10).

14 Claims, 8 Drawing Sheets

(51) Int. Cl.

| | |
|---|---|
| ***B22D 17/04*** | (2006.01) |
| ***B22D 17/14*** | (2006.01) |
| ***B22D 17/28*** | (2006.01) |
| ***B22D 17/30*** | (2006.01) |
| ***B22D 21/00*** | (2006.01) |
| ***H05B 6/10*** | (2006.01) |
| ***H05B 6/26*** | (2006.01) |

(52) U.S. Cl.

CPC ..... *B22D 17/2023* (2013.01); *B22D 17/2038* (2013.01); *B22D 17/28* (2013.01); *B22D 17/30* (2013.01); *B22D 21/005* (2013.01); *H05B 6/10* (2013.01); *H05B 6/26* (2013.01)

HIGH-PRESSURE CASTING METHOD AND HIGH-PRESSURE CASTING DEVICE

CROSS REFERENCE TO RELATED APPLICATIONS

This application is a National Stage of International Application No. PCT/JP2015/050021, filed Jan. 5, 2015, claiming priority based on Japanese Patent Application No. 2014-002978, filed Jan. 10, 2014, the contents of all of which are incorporated herein by reference in their entirety.

TECHNICAL FIELD

The present invention relates to a high-pressure casting method and a high-pressure casting device, and more specifically, to the high-pressure casting method and the high-pressure casting device which are suitable for high-quality and high-efficient casting of a high-fusion-point metal having a fusion point exceeding 1000 K.

BACKGROUND ART

Conventionally, die casting has been performed as the high-pressure casting method of the metal. The die casting is a method for performing casting by pouring, at high pressure, the metal melted (molten metal) in a precision mold, and this method allows production of castings each having high dimensional accuracy in a short period of time. The die casting device has: a hot-chamber type which has a heat retention furnace as apart of the device and which injection-fills, with a plunger, a molten metal in the melting pot disposed in the furnace into a cavity, via a sleeve in the gooseneck; and a cold-chamber type which places a heat retention furnace near the die casting machine, which pours, with a ladle or an automatic molten metal supplying device, the molten metal in the furnace into the injection sleeve, and which injection-fills, with a plunger, the molten metal into a cavity. Each type includes a vertical die casting device for vertical injection, and a horizontal die casting device for horizontal injection.

Since, in the hot-chamber type, members such as a plunger tip, a sleeve, and a gooseneck are constantly immersed in the molten metal in the melting pot, it is difficult to perform die casting of the metal having a high fusion point, with the result that this type is used for casting of the metal having a fusion point of substantially 700 K, such as zinc alloy.

The cold-chamber type allows casting of a metal having a higher fusion point than that in the hot-chamber type. However, a general method for performing injection-filling of the molten metal at high speeds may cause a problem of easily generating entrainment of gas inside the injection sleeve, and generating a blow hole resulting from rapid solidification in the cavity. Furthermore, there exist a problem of easily forming a solidified layer on the inner wall of the injection sleeve at the time of pouring of the molten metal and of breaking the solidified layer by the plunger tip to thereby generate casting defects as a broken chilled layer, and a problem of thermally deforming the injection sleeve by uneven heating at the time of pouring of the molten metal to thereby damage the injection sleeve and the plunger tip.

As a special die casting method for solving the above-described problems, there is performed a molten metal forging method referred to as squeeze die casting, in which the vertical die casting device performs injection-filling of the molten metal at the low speed and a high pressure state is held until the completion of solidification. This method provides high-quality casting having less blowhole, but since a thermal load applied to the injection sleeve and the mold is large, this method is not applied to a material having a higher fusion point than that of the aluminum alloy.

As described above, a material mass-produced by using the conventional die casting device is limited to a metal having a fusion point up to approximately 1000 K, such as zinc alloy, aluminum alloy, or magnesium alloy. However, there is disclosed the method for molding a high-fusion-point metal such as titanium alloy by using the conventional horizontal die casting device.

For example, Patent Literature 1 discloses, as a device for a die cast material having a high fusion point exceeding 2000° F., such as superalloy or titanium alloy, the die casting device which allows selection of the ratio between the internal diameter and the external diameter of the injection sleeve so as to minimize the thermal deformation of the injection sleeve at the time of pouring of the molten metal.

In addition, Patent Literature 2 discloses, as a method for die casting a material having a high fusion point or the material having high reactivity, a method: of maintaining a melting device of a casting material, the injection sleeve, and the die cavity in a non-reactive atmosphere; of then reducing a particle size by solidification, at a high temperature but rapidly at the time of injection so that a molten state is maintained until injection of the material; and of melting the casting material in an overheating state of reducing the thermal load applied to the die casting device for pouring the molten material into the injection sleeve so as to allow the plunger and of thus performing injection into the die cavity.

Furthermore, Patent Literature 3 discloses the method and the device for molding a high-fusion-point metal and an activated metal by using the vertical die casting device. For example, in the vacuum vertical injection casting method which allows high-speed casting in an extremely clean state without generating the blowhole and oxide entrainment irrespective of the active metal, there is disclosed a method in which a metal block is input to the injection sleeve to make the atmosphere surrounding the injection sleeve into a vacuum state, then the block is melted while the vacuum state is maintained, and thereafter, the injection sleeve is connected to the gate of the mold and the molten metal in the injection sleeve is injection-filled into the mold kept under the vacuum state.

Moreover, Patent Literature 4 discloses an injection casting device, even in injection casting of the high fusion point metal having fusion point of about 1200° C. or more, the device being unlikely to intrude the molten metal under the heat into the gap between the plunger and the sleeve, and being capable of smooth sliding movement of the plunger inside the sleeve to thereby allow manufacturing a high-quality casting product in a stable state; the injection casting device includes a mold, a sleeve disposed movably forward and backward with respect to the gate of the mold, a plunger slidably disposed in the sleeve, and heating means for heating and melting the material block supplied to the material container formed by the inner wall of the sleeve and the plunger; and the device has the plunger and/or the sleeve provided with cooling means.

In contrast, the inventor of the present invention proposes a high-pressure casting method of a high-fusion-point metal, as the high-pressure casting method of the high fusion-point-metal, efficiently solving the problem resulting from the solidified layer formed on the inner wall of the injection sleeve, and the thermal deformation of the injection sleeve; in the method, the injection container is constituted by an injection sleeve, and a plunger tip that is slidably fitted in the injection sleeve and is not fixed to the plunger, the casting material is loaded into the injection container, the melting container is disposed inside the induction heating coil in a state of being separated from the casting port, the injection container is heated and the casting material is melted, then the melting container is linearly moved to thereby be connected to the casting port, and the plunger in a state of being separated from the plunger tip is impinged against the plunger tip at a predetermined speed and thus the molten metal in the injection container is immediately injection-filled into the cavity (Patent Literature 5).

CITATION LIST

Patent Literature

PTL 1: Japanese Patent Laid-Open No. 2000-197957
PTL 2: Japanese Unexamined Patent Application Publication (Translation of PCT Application) No. 2002-532260
PTL 3: Japanese Patent Laid-Open No. 05-318077
PTL 4: Japanese Patent Laid-Open No. 2005-199309
PTL 5: Japanese Patent Laid-Open No. 2006-281243

SUMMARY OF INVENTION

Technical Problem

The method described in Patent Literature 1 is designed to minimize uneven thermal deformation of the injection sleeve at the time of pouring of the molten metal to thereby prevent damage to the device, by appropriately setting the internal diameter of the injection sleeve, the ratio between the internal diameter and the external diameter of the injection sleeve, and pouring amount of the molten metal relative to the injection sleeve capacity. However, the problem of the solidified layer formed on the inner wall of the injection sleeve cannot be solved. There is a fear that the solidified layer formed on the inner wall of the injection sleeve may not only cause cast defect as a broken chill layer, but also destroy the device in the case where such layer is rigidly formed.

Furthermore, the method described in Patent Literature 2 is not different from the conventional cold chamber type except that the device for melting the cast material, the injection sleeve, and the die cavity are maintained in a non-reactive atmosphere. Namely, there are not solved the problem of formation of the solidified layer on the inner wall of the injection sleeve at the time of pouring of the molten metal, and the problem of thermal deformation of the injection sleeve.

As described above, it is difficult, by using the conventional die casting device, to mold the high-fusion-point metal such as titanium alloy into a high-quality product, and the molding method has been hardly performed in a practical sense.

In contrast, the method described in Patent Literature 3, which uses the device of vertical type, is for melting the casting material in the injection sleeve, but this method has a disadvantage that the molten metal is likely to intrude into the gap between the plunger and the injection sleeve because the temperature of the injection sleeve becomes high. There is a fear that the solidified substance of the molten metal which has intruded into the gap not only generates a cast defect by being mixed with the molded product, but also damages the device as a result of interference with the sliding motion of the plunger. Accordingly, it is necessary to set the gap between the plunger and the injection sleeve in a high-temperature state to be as narrow as possible, but in the disclosed method, there is a problem of difficulty in heating the plunger because the plunger is fixed to the cylinder rod and of increasing the gap between the plunger and the injection sleeve as the temperature becomes higher.

The method described in Patent Literature 4 is designed so that the plunger and the injection sleeve are provided with cooling means to thereby cool the upper portion of the plunger, in order to solve the problem of intrusion of the molten metal into the gap between the plunger and the injection sleeve as described above. However, in this method, a large temperature difference is caused between upper and lower sections of the Injection sleeve, and the gap between the injection sleeve and the plunger is increased as getting closer to the upper end of the injection sleeve, and thus, even if the upper section of the plunger is cooled, the molten metal intruding into the gap cannot be eliminated. In order to stably mold the high-quality castings, it is necessary to completely remove the residual solidified substance for each molding, but there is a problem in which the method is not suitable for maintenance for each molding because the structure around the plunger and the injection sleeve is complicated.

The high-pressure casting method described in Patent Literature 5 is designed to uniformly heat the injection sleeve and the plunger tip up to near the molten metal temperature, and thus fitting between these members is kept unchanged over an entire sliding process of the plunger tip. Accordingly, the method allows the gap between the injection sleeve and the plunger tip to be narrower than those disclosed in Patent Literatures 3 and 4. However, the plunger tip heated up to near the molten metal temperature in the injection sleeve which has been heated up to near the molten metal temperature pressurizes the molten metal, and thus a problem is caused in which the molten metal intruding into the gap is not solidified. Therefore, in a case where the surge pressure at the time of completion of filling is large, there is a fear of reverse jetting of the molten metal toward the rear of the plunger tip, and thus there has been a problem in which the suppression of the injection speed for preventing the reverse jetting may not allow sufficient fluidity.

In addition, the high-pressure casting method as described in Patent Literatures 3 and 5 does not have means for forcedly cooling the injection sleeve which has been heated up to near the temperature of the molten metal, and much time is required for cooling the injection sleeve, with the result that there has been a disadvantage of poor production efficiency.

Furthermore, in the high-pressure casting method as described in Patent Literatures 3 to 5, a molten state of the casting material cannot be directly confirmed, and thus the excessive heating temperature is required to be set high or the melting time is required to be set long, with the result that there has been a disadvantage of progressing oxidation of the molten metal.

Moreover, the high-pressure casting method as described in Patent Literatures 4 and 5 has no mechanism for mechanically stirring the molten metal, and thus there has been an disadvantage that gravity segregation cannot be prevented through the use of the graphite injection sleeve in which electromagnetic force does not act on the molten metal.

Accordingly, an object of the present invention is to provide a casting method, on the basis of the high-pressure casting method of the high-fusion-point metal as described in Patent Literature 5, which allows reliable prevention of reverse jetting of the molten metal without impairing its fluidity, which allows suppression of oxidation and segregation of the molten metal, and which has high productivity; and is to thereby try to provide high-quality castings of the high-fusion-point metal at low cost.

In addition, another object of the present invention is to provide a device having a fundamental configuration suitable for high-quality casting of the above-described high-fusion-point metal at low cost.

Solution to Problem

Therefore, in order to achieve the above-described objects, in a high-pressure casting method for injection-filling of a molten metal pressurized with a plunger into a cavity, in which a melting container of cartridge type constitutes an injection sleeve detachably communicating with a casting port bush, and a plunger tip which is slidably fitted in the injection sleeve and is not fixed to the plunger, the method includes; after loading the melting container with a casting material, disposing the melting container in an induction heating coil and melting the casting material, in a state where the melting container is separated from the casting port bush and the plunger; linearly moving the melting container so as to pass through an inside of a guide connected to the casting port bush to thereby be communicated therewith, and setting the melting container to a cooling state in close contact with the guide; and subsequently, bringing the plunger into contact with the plunger tip, immediately transferring the plunger into the casting port bush together with the molten metal, and then pressurizing the molten metal inside the casting port bush and injection-filling the molten metal into the cavity.

In addition, the second solution for the problem includes melting the casting material in a vacuum atmosphere or an inert atmosphere and injection-filling the molten metal into the cavity in a depressurized state.

Additionally, the third solution for the problem includes removing the injection sleeve, the plunger tip, and the casting port bush from a main body of a device for each molding.

Furthermore, the fourth solution for the problem includes inclining the melting container to a vertical direction in melting of the casting material.

Moreover, the fifth solution for the problem includes mechanically stirring the molten metal in the melting container in melting of the casting material.

In addition, the sixth solution includes a high-pressure casting device for injection-filling of a molten metal pressurized by a plunger into a cavity, and the device includes a cylindrical guide attached in a through-hole of a fixed die plate; a casting port bush detachably connected to an upper portion of the guide; an injection sleeve detachably communicating with a lower end of the casting port bush; a plunger tip which is slidably fitted in the injection sleeve and is not fixed to the plunger; a moving rod which linearly movies the injection sleeve so as to be detachably supported to pass through the guide, and communicates the injection sleeve with the lower end of the casting port bush; an induction heating coil which is disposed in a movable range of the injection sleeve and which is for melting the casting material in the injection sleeve; and a holder capable of gripping the injection sleeve to be disposed in the induction heating coil, and capable of receiving and sending the injection sleeve from and to the moving rod, wherein the guide is set so as to be brought into a close contact state in a state where the injection sleeve communicates with the casting port bush.

Additionally, the seventh solution for the problem includes a vacuum chamber which covers a space including the holder, communicates with the casting port bush on one side, and has, on the other side, the moving rod that is slidably inserted while shielding outside air.

Furthermore, the eighth solution for the problem is configured such that the moving rod operates so as to extrude and remove the casting port bush together with the injection sleeve.

Moreover, the ninth solution for the problem includes an inclination mechanism for inclining the injection sleeve to a vertical direction.

Additionally, the tenth solution for the problem includes a rotation mechanism for rotating the injection sleeve around its center axis.

In addition, the eleventh solution for the problem includes a shielding mechanism for freely openably/closably covering a part of an upper opening portion of the injection sleeve.

Furthermore, the twelfth solution for the problem includes a nozzle for jetting an inert gas toward an inside of the injection sleeve.

Moreover, the thirteenth solution for the problem is configured such that the injection sleeve is made of graphite.

Additionally, the fourteenth solution for the problem is configured such that the plunger tip is made of graphite.

The function derived from the first solution will be described as below. Namely, the casting material in the melting container is melted in a state apart from the casting port bush and the plunger, and thus uniform heating of the overall melting container up to a fusion point or higher is possible without causing any problem resulting from heat release through heat conduction and thermal expansion restraint. Accordingly, it is possible to solve a problem of the formation of the solidified layer on the inner wall of the injection sleeve, and a problem of damaging the injection sleeve and the plunger tip owing to the uneven thermal deformation of the injection sleeve.

In addition, since the overall melting container is thermally uniformized, fitting between the plunger tip and the injection sleeve is kept unchanged over the entire sliding process of the plunger tip. Therefore, no hindrance to the sliding motion of the plunger is caused even if the gap between the plunger tip and the injection sleeve is set to be narrow.

Furthermore, it is possible to make a center axis of the melting container coincident with a center axis of the casting port bush, by guiding, with the guide, the melting container in communicating the melting container with the casting port bush. Accordingly, it is possible to minimize a deviation of the fitting, generated when the plunger tip moves from the injection sleeve to the casting port bush.

Moreover, the melting container is rapidly cooled while being made tightly contact with the guide, and thus a temperature boundary layer is generated in a vicinity of the molten metal in contact with the injection sleeve, with the result that the molten metal in the region generates the steep temperature gradient. Accordingly, it is possible to locally increase viscosity of the molten metal in contact with the injection sleeve without largely impairing the molten metal fluidity as a whole, and furthermore, it is possible to adjust a balance between the viscosity and the fluidity, by changing the time taken for cooling the molten metal in the melting container (time taken for transferring the molten metal from the melting container to the casting port bush). In addition, in order to transfer the molten metal by the plunger tip in an instant, the temperature around the molten metal area is maintained in a low state even after the transfer into the casting port bush, and thus it is possible to suppress intrusion of the molten metal into the gap between the plunger tip and the casting port bush, and to reduce the thermal load applied to the casting port bush.

In addition, the cavity is filled with the molten metal under pressure after the transfer of the plunger tip and the molten metal to the low-temperature casting port bush, and thus a small amount of the molten metal is solidified in an instant even by intrusion into the gap between the casting port bush and the plunger tip. Therefore, it is possible to ensure prevention of reverse jetting of the molten metal by adjusting the time taken for transferring the molten metal from the melting container to the casting port bush, and by suppressing the amount of the molten metal intruding into the gap between the casting port bush and the plunger tip.

Namely, it is possible to achieve two tasks of ensuring the molten metal fluidity and prevention of reverse jetting which have been a trade-off relation by the conventional method, through the use of a simple method of adjusting the time taken for transferring the molten metal to the casting port bush, by rapid cooling of the melting container in close contact with the guide, and pressurization of the molten metal that has been transferred into the low-temperature casting port.

Furthermore, since the plunger tip is separated from the plunger, the plunger tip is operated at high speeds by accelerating the plunger at sufficient stroke, without being restricted by the sliding distance of the plunger tip in the injection sleeve.

Moreover, it is possible to reduce the time required for replacement of the melting container and to thereby enhance productivity, by forced cooling of the high-temperature injection sleeve up to near room temperature. The melting container is a cartridge type and thus exhibits excellent maintainability. The use of a plurality of melting containers allows complete removal of residues for each molding, without stopping the device for maintenance purpose for a long time.

Additionally, the function derived from the second solution makes it possible to prevent the casting material from reacting with the atmosphere to be oxidized, and to prevent the cast defect caused by air entrained in the molten metal at the time of injection-filling.

In addition, the function derived from the third solution makes it possible to completely remove the solidified residues as a result of intrusion into the gaps between the casting port bush and the plunger tip, and between the injection sleeve and the plunger tip and thus to prevent the previous molding residues from causing a cast defect by being mixed with the molded product, and prevent the device from damaging as a result of interference with the sliding motion of the plunger tip.

Furthermore, the function derived from the fourth solution makes it possible to observe the inside of the melting container from the direction where the mold does not become obstacle by inclining the melting container, to confirm a melting state of the casting material, and to perform the temperature measurement by the radiation thermometer.

Moreover, the function derived from the fifth solution prevents the gravity segregation through mechanical forced convection of the molten metal even in the case of using the metal or graphite injection sleeve which refrains electromagnetic force from stirring the molten metal upon induction heating. Furthermore, thermal uniformization in a short period of time may prevent contamination of the molten metal by the melting container or atmosphere.

In addition, the function derived from the sixth solution embodies the first solution by a specific device structure.

Additionally, the function derived from the seventh solution embodies the second solution by the specific device structure.

Furthermore, the function derived from the eighth solution makes it possible to embody the third solution safely, which allows removing the casting port bush easily and without forcible hollowing-out, fitted to the fixed mold and the guide on the basis of fitting states without rattling, through vertical extrusion together with the injection sleeve by using a moving rod.

Moreover, the function derived from the ninth solution embodies the fourth solution by the specific device configuration.

In addition, the function derived from the tenth solution embodies the fifth solution by the specific device configuration.

Additionally, the function derived from the eleventh solution enhances heating efficiency of the casting material by suppressing radiation heat transfer from the inside of the injection sleeve to thereby reduce the melting time, prevents contamination of the molten metal, and suppresses local heating of the vacuum chamber.

Furthermore, the function derived from the twelfth solution lowers an oxygen concentration while increasing a pressure of the injection sleeve by jetting an inert gas toward the inside of the injection sleeve, and reduces evaporation loss during melting of the casting material and loss due to formation of an oxide.

Moreover, the function derived from the thirteenth solution makes it possible to heat the injection sleeve by itself to the temperature equal to or higher than the fusion point of the casting material through induction heating, and causes no hindrance to the sliding motion even if the fitting between the injection sleeve and the plunger tip is set to have no gap.

In addition, the function derived from the fourteenth solution makes it possible to heat the plunger tip by itself to the temperature equal to or higher than the fusion point of the casting material through induction heating, and causes no hindrance to the sliding motion even if the fitting between the plunger tip and the injection sleeve is set to have no gap.

Advantageous Effects of Invention

As described above, the method and the device according to the present invention allow high-quality and high-efficient casting in spite of the high-fusion-point metal having a fusion point exceeding 1000 K.

DESCRIPTION OF EMBODIMENTS

Figure 1:
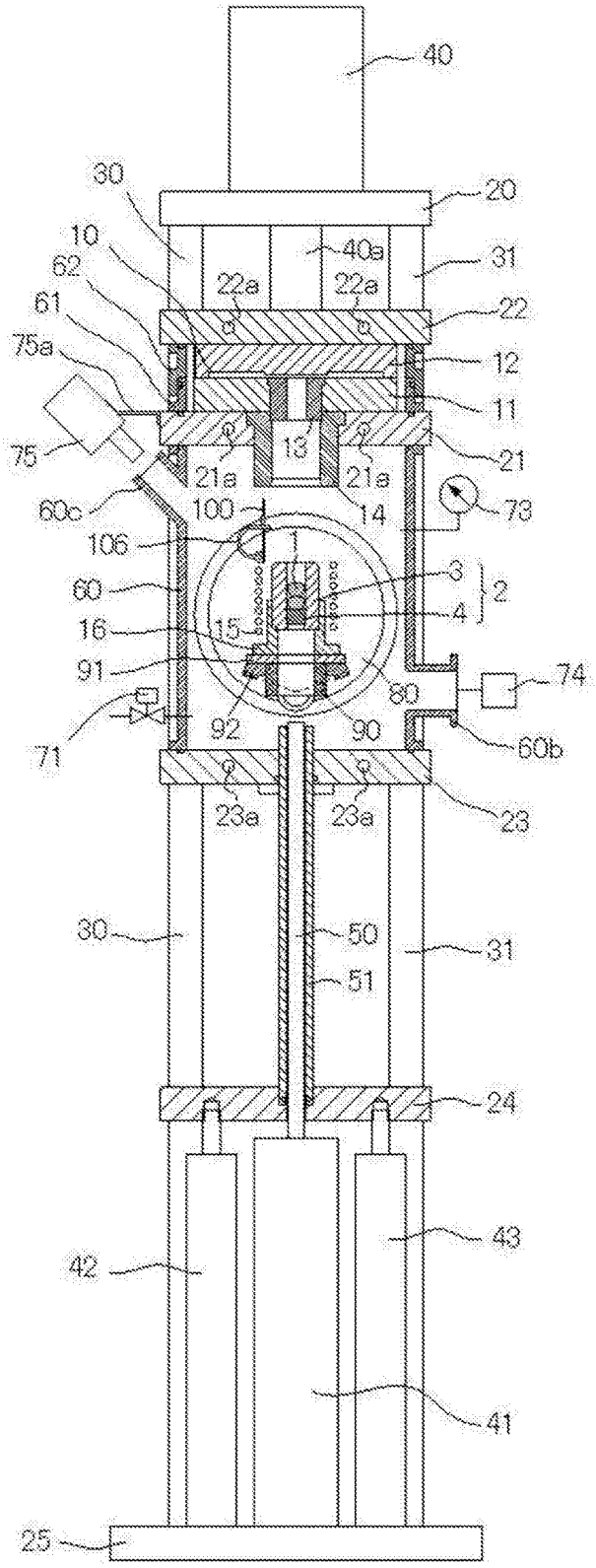
FIG. 1 is a front view showing a partial cross-section of a schematic configuration according to an embodiment of the present invention.

Hereinafter, the present invention will be described in detail on the basis of embodiments shown in the drawings. However, the respective components, shapes, relative arrangement, and the like described in the embodiments are not intended to restrict the scope of the present invention, but are merely examples for explanation unless otherwise specified herein.

Figure 2:
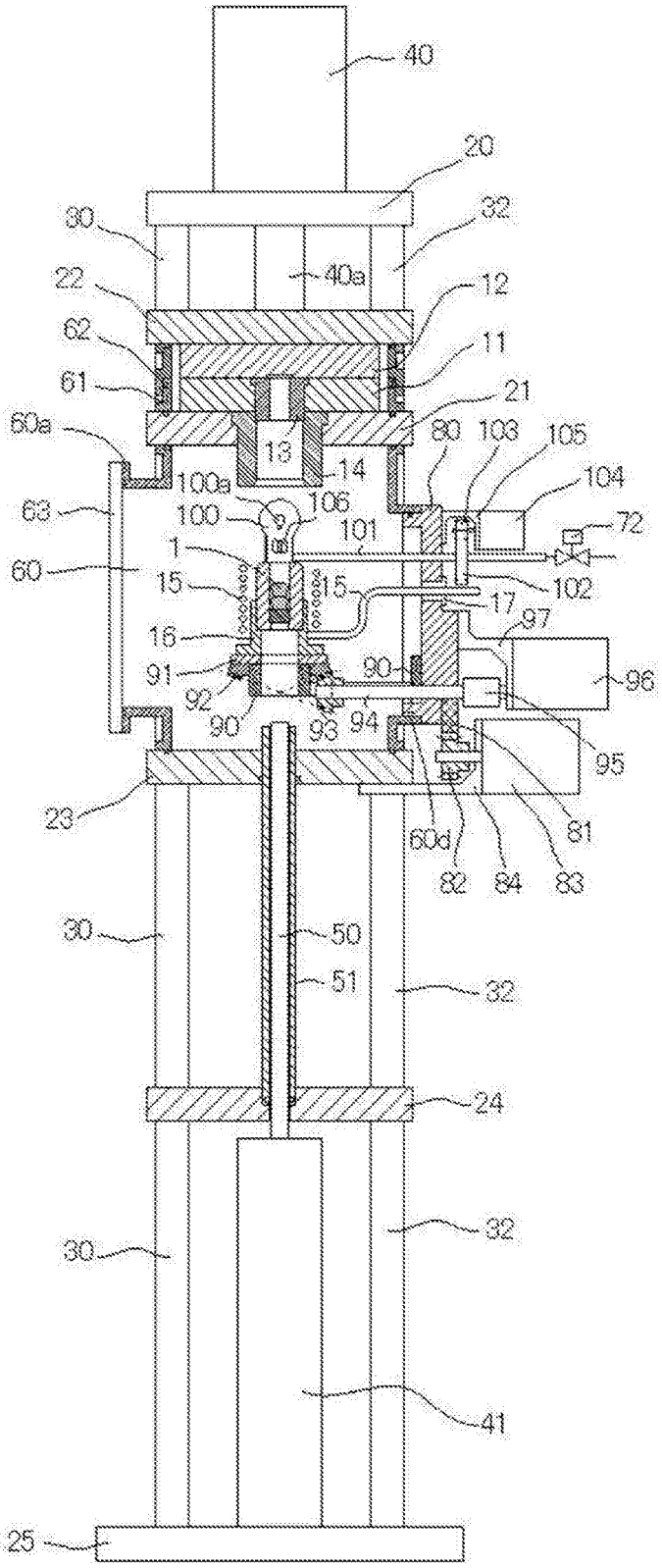
FIG. 2 is a side view showing a partial cross-section of the schematic configuration according to an embodiment of the present invention.
Figure 3:
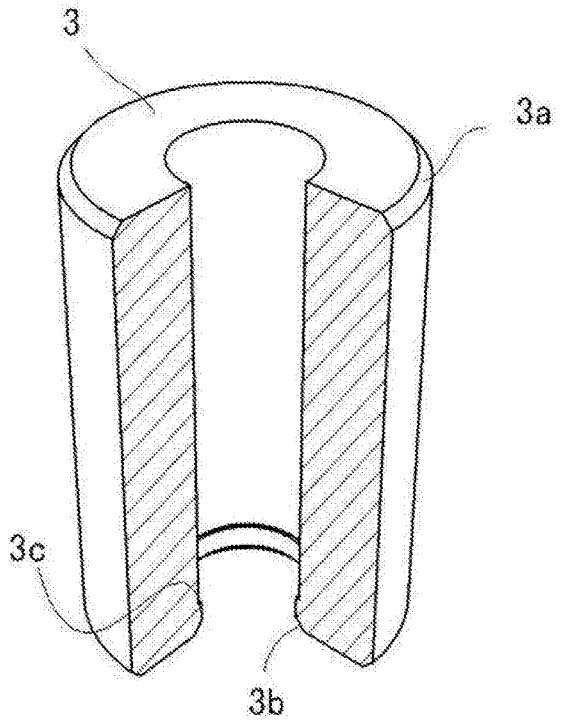
FIG. 3 is a perspective view showing a partial cross-section of an injection sleeve according to an embodiment of the present invention.

FIGS. 1 and 2 are front and side views showing partial cross-sections of the schematic configuration of a high-pressure casting device according to an embodiment of the present invention. A melting container 2 for melting a casting material 1 is constituted by an injection sleeve 3, and a plunger tip 4 which is slidably fitted in the injection sleeve 3 and is not fixed to a plunger 50. Both the injection sleeve 3 and the plunger tip 4 are made of graphite, and as shown in FIG. 3, an upper end outer circumference and a lower end inner circumference of the injection sleeve 3 are subjected to chamfering 3*a* and 3*b*, respectively. A stepped portion 3*c* is provided in the inner circumference near the lower end, for the purpose of preventing the plunger tip 4 from falling out.

Figure 4:
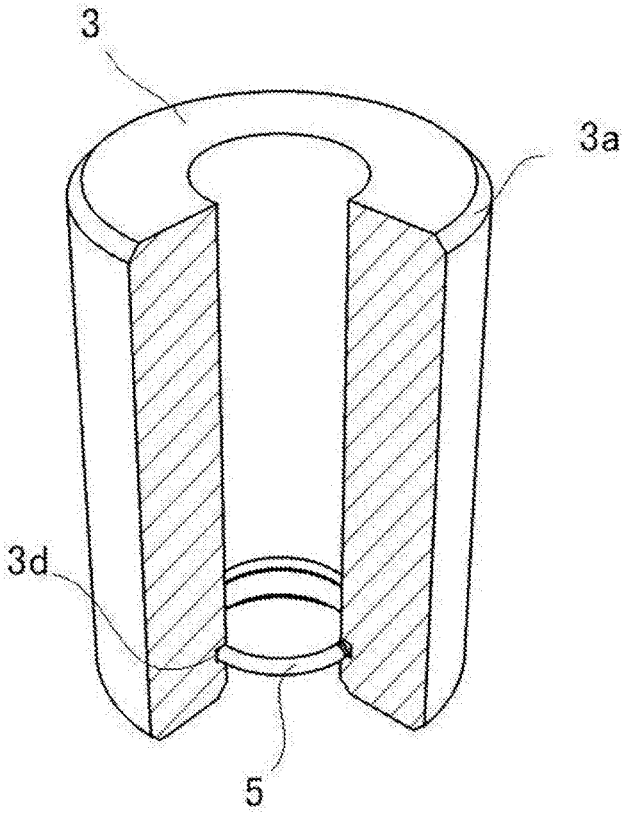
FIG. 4 is a perspective view showing a partial cross-section of a modification of the injection sleeve as shown in FIG. 3.

FIG. 4 is a perspective view showing a partial cross-section of a modification of the injection sleeve 3. In this case, a retaining ring 5 is used for preventing the plunger tip 4 from falling out, and the injection sleeve 3 is provided with a groove portion 3*d* for mounting the retaining ring 5 therein.

In FIG. 1, a fixed mold 11 and a movable mold 12 which constitute a cavity 10 are fixed to a fixed die plate 21 and a movable die plate 22, respectively. The fixed die plate 21 and the movable die plate 22 are provided with cooling holes 21*a* and 22*a*, respectively. A guide 14 for performing positioning in communicating the injection sleeve 3 with a casting port bush 13 is attached to the fixed die plate 21, and the casting port bush 13 penetrates through the fixed mold 11 and can be detachably fitted to both the fixed mold 11 and the guide 14.

Figure 5:
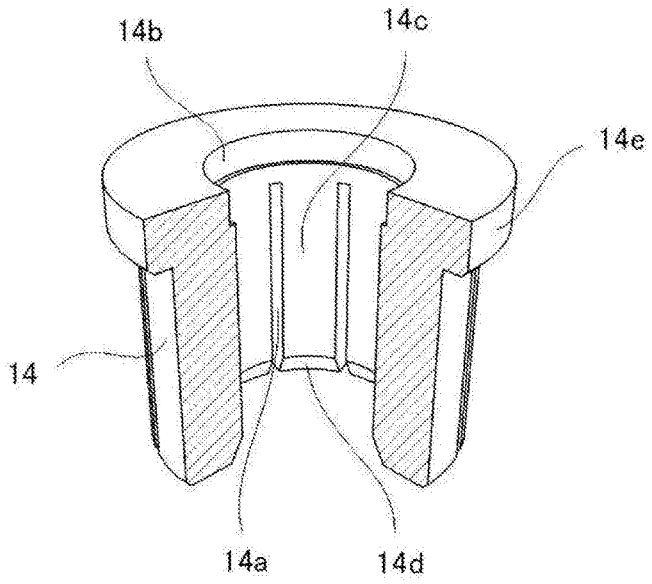
FIG. 5 is a perspective view showing a partial cross-section of a guide according to an embodiment of the present invention.
Figure 6:
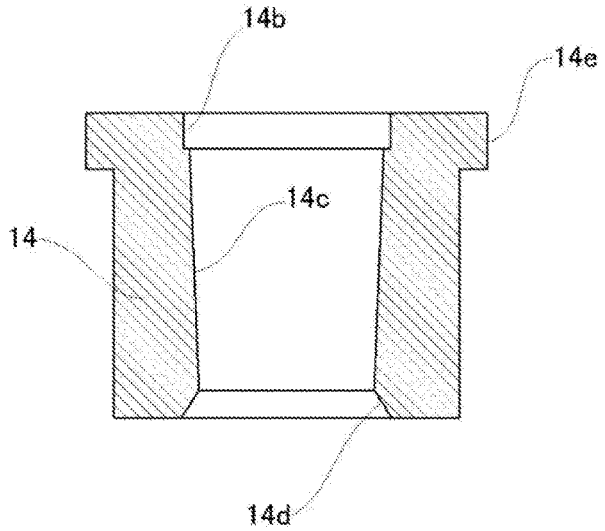
FIG. 6 is a cross-sectional view of the guide as shown in FIG. 5.
Figure 7:
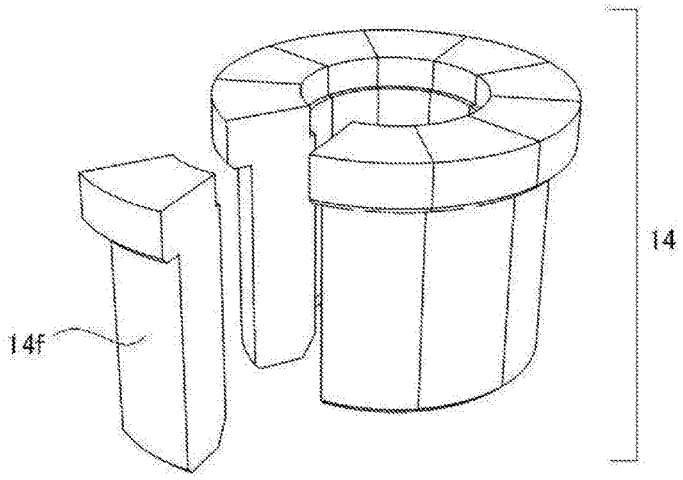
FIG. 7 is a perspective view showing a partial cross-section of a modification of the guide as shown in FIG. 5.

As shown in FIG. 5, the guide 14 has substantially a cylindrical shape, is provided with at least one slit 14*a*. A fitting portion 14*b* has an internal diameter which allows the casting port bush 13 to be detachably fitted on the basis of fitting states without rattling. As shown in FIG. 6, an inside of a guide portion 14*c* has a tapered shape slightly closed to the side where the injection sleeve 3 is inserted, and has a maximum internal diameter substantially the same as an external diameter of the injection sleeve 3. Therefore, the guide portion 14*c* is elastically widened by insertion of the injection sleeve 3, and performs guiding without rattling while maintaining a contact state until the injection sleeve 3 communicates with the casting port bush 13. In this way, the utilization of an elastic recovery force of the guide portion 14*c* allows making the center axis of the casting port bush 13 accurately coincident with the center axis of the injection sleeve 3, and allows realizing a close contact state sufficiently required for rapid cooling of the injection sleeve 3. Note that the guide 14 can also be constituted by arranging a plurality of guide segments 14*f* concentrically as a modification shown in FIG. 7.

Figure 8:
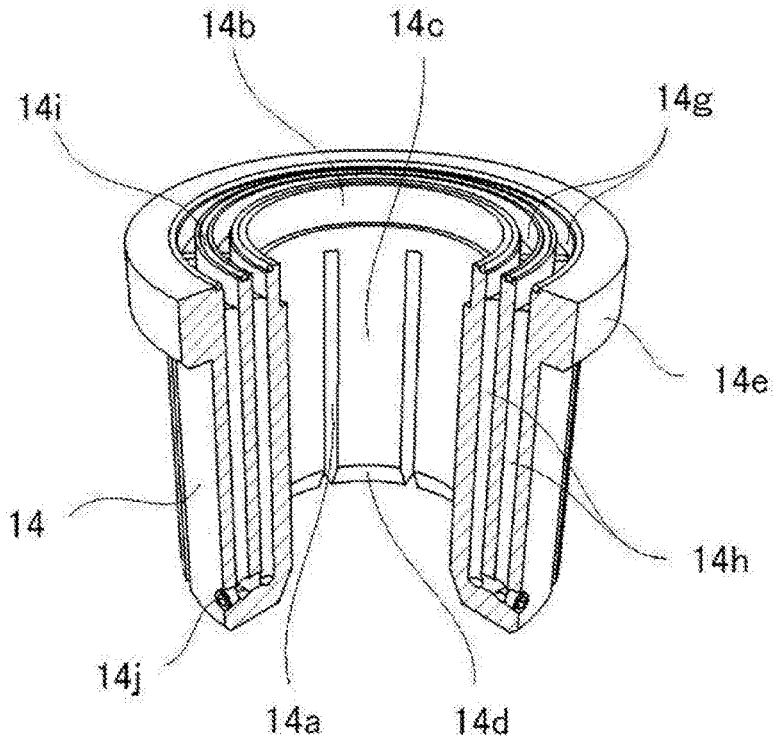
FIG. 8 is a perspective view showing a partial cross-section of another modification of the guide as shown in FIG. 5.

The guide 14 receives heat from the injection sleeve 3, and radiates heat to the fixed die plate 21, and a flange portion 14*e* of the guide 14 is only fixed to the fixed die plate 21. Therefore, in the case of low heat capacity and poor thermal conductivity of the guide 14, the heat radiation does not keep up with the heat reception, and thus the temperature at the inside of the guide portion 14*c* increases in a short time, thereby making it difficult to rapidly cool the injection sleeve 3. Accordingly, the guide 14 is required to have a heat capacity at least equal to or more than that of the injection sleeve 3, and required to be constituted of a material having a high thermal conductivity such as metal or graphite, and as in another modification shown in FIG. 8, cooling holes 14*h* may be provided in the guide portion 14*c* for forced cooling. However, in this case, a water channel for supply and drainage of water to and from a cooling groove 14*g* is required to be provided in both the fixed die plate 21 and the fixed mold 11.

In FIG. 1, a fixed housing 61 and a movable housing 62 which surround the mold are attached to the fixed die plate 21 and the movable die plate 22, and the space around the mold is isolated in interlocking with opening and closing of the mold. Note that the parts for attaching the fixed housing 61 and the movable housing 62, and the parts for fitting between those housings are vacuum-sealed.

A vacuum chamber 60 is attached between a base plate 23 and the fixed die plate 21, and the respective attachment portions are vacuum-sealed. The vacuum chamber 60 is provided with a hatch 60*a*, an exhaust port 60*b*, a view port 60*c*, and a back port 60*d*, to which a leak valve 71, a vacuum gauge 73, and a vacuum evacuation device 74 are attached. The door 63 is openably/closably attached to the hatch 60*a*, and the space between the door 63 and the hatch 60*a* is vacuum-sealed.

The view port 60*c* is provided so that the inside of the injection sleeve 3 is observed by inclining the injection sleeve 3. A radiation thermometer 75 capable of observing the target substance through the view finder is attached outside the view port 60*c*, and makes it possible to measure the temperature of the casting material 1 while confirming a melting state of the casting material 1.

A back plate 80 is rotatably fitted to the back port 60*d* in a vacuum-sealed state, and a support arm 90 is attached to the vacuum chamber 60 side of the back plate 80, and an induction heating coil 15 is also attached via an insulation member 17. Furthermore, a sector gear 81, a rotation motor 96, and a shielding motor 104 are attached to the outside of the back plate 80. A rotation shaft 94 and a shielding shaft 101 rotatably penetrate through the back plate in a vacuum-sealed state. Moreover, a rotation table 91 having a large bevel gear 92 is rotatably fitted to the support arm 90, on which a holder 16 for detachably gripping the injection sleeve 3 is attached.

Figure 9:
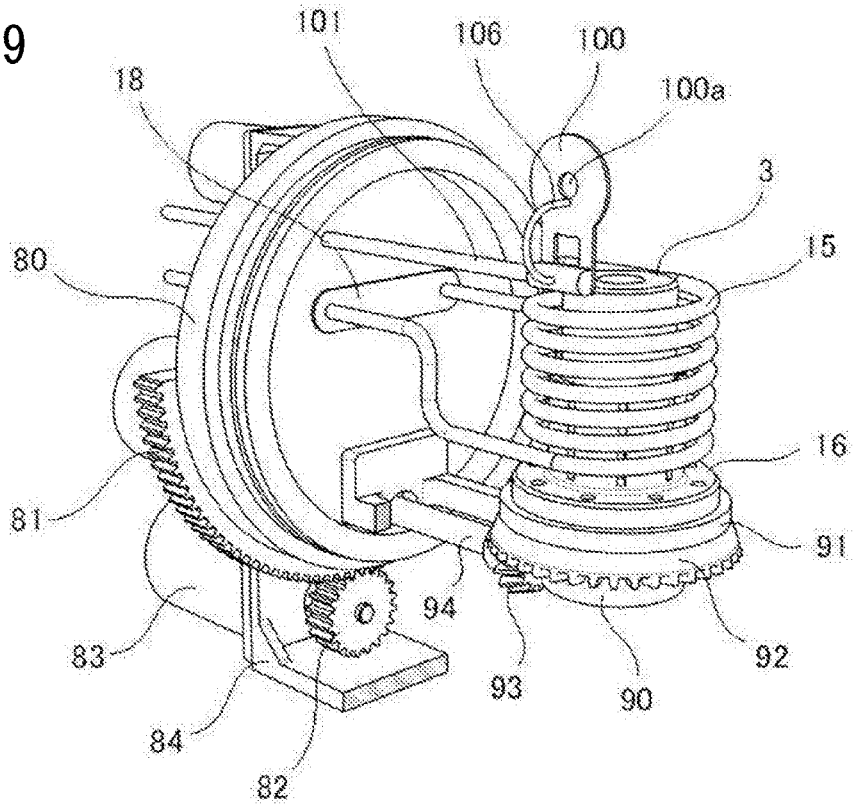
FIG. 9 is a perspective view showing a partial cross-section of a schematic configuration including an inclination mechanism, a rotation mechanism, and a shielding mechanism according to an embodiment of the present invention, in a state before operation.
Figure 10:
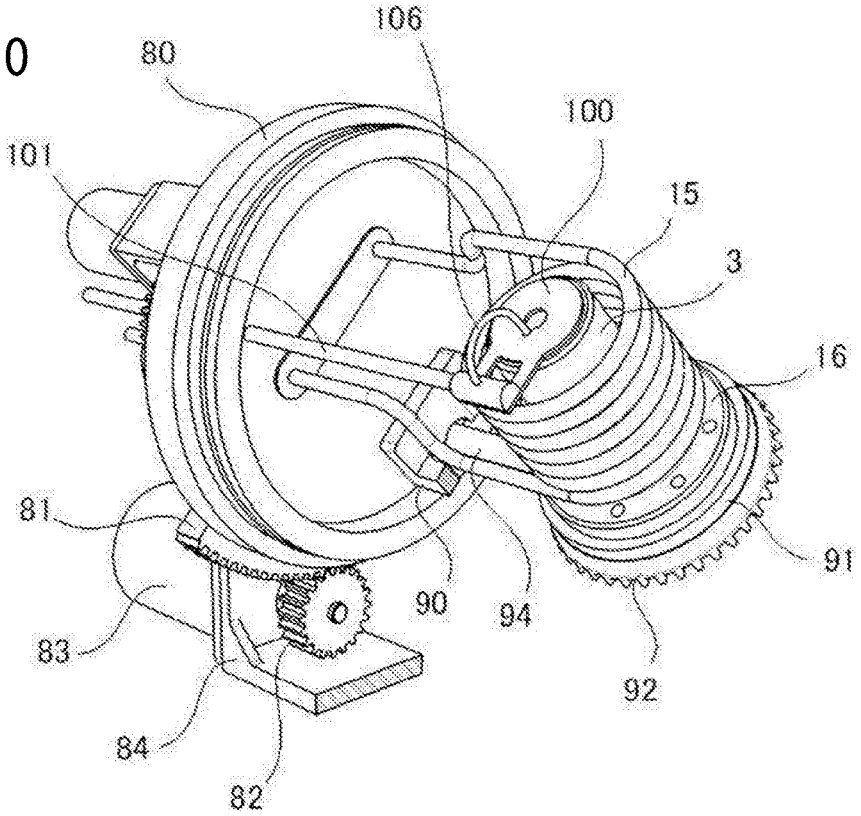
FIG. 10 is a perspective view showing a partial cross-section of the schematic configuration including the inclination mechanism, the rotation mechanism, and the shielding mechanism as shown in FIG. 9, in a state after operation.

FIGS. 9 and 10 are perspective views of schematic configurations including an inclination mechanism, a rotation mechanism, and a shielding mechanism. FIG. 9 shows a state before operation, and FIG. 10 shows a state after operation. The inclination mechanism for inclining the injection sleeve 3 is constituted by the back port 60*d*, the back plate 80, the sector gear 81, a pinion gear 82, an inclination motor 83, and an inclination motor mount 84. The injection sleeve 3 is inclined by rotating, with the inclination motor 83, the back plate 80 via the sector gear 81 and the pinion gear 82, and by integrally inclining the holder 16 connected to the back plate 8 and the induction heating coil 15.

The rotation mechanism for rotating the injection sleeve 3 is constituted by the support arm 90, the rotation table 91, the large bevel gear 92, a small bevel gear 93, the rotation shaft 94, a coupling 95, the rotation motor 96, and a rotation motor mount 97. The rotation table 91, the large bevel gear 92, and the support arm 90 have holes through which the moving rod 51 penetrates. Furthermore, the injection sleeve 3 is rotated by leading the rotation of the rotation motor 96 disposed outside the vacuum chamber 60 to the inside of the vacuum chamber 60 via the coupling 95 and the rotation shaft 94 and by rotating the holder 16 attached to the rotation table 91 through conversion of the rotating direction at 90° with the small bevel gear 93 and the large bevel gear 92.

The shielding mechanism freely openably/closably covers a part of the upper opening portion of the injection sleeve 3 is constituted by a shielding plate 100, a shielding shaft 101, a spur gear 102, a pinion 103, a shielding motor 104, and a shielding motor mount 105. The shielding plate 100 is provided with a hole 100*a* for temperature measurement and internal observation. The upper opening portion of the injection sleeve 3 is shielded by decelerating rotation of the shielding motor 104 by the pinion 103 and the spur gear 102 to thereby transfer the rotation to the shielding shaft 101 and by rotating the shielding plate 100 until the plate is brought into contact with or substantially contact with the upper surface of the injection sleeve 3. A nozzle 106 attached to the shielding plate 100 communicates with the shielding shaft 101 having a hollow structure, and the inert gas introduced from a gas introduction valve 72 is jetted into the injection sleeve 3.

The induction heating coil 15 is fixed to the back plate 80 via the insulation member 17 and is installed so that the moving rod 51 passes through the center in a state where the center axis is vertically directed. Note that each space between the induction heating coil 15 and the insulation member 17, and between the insulation member 17 and the back plate 80 is vacuum-sealed with a not shown sealing member.

Figure 11:
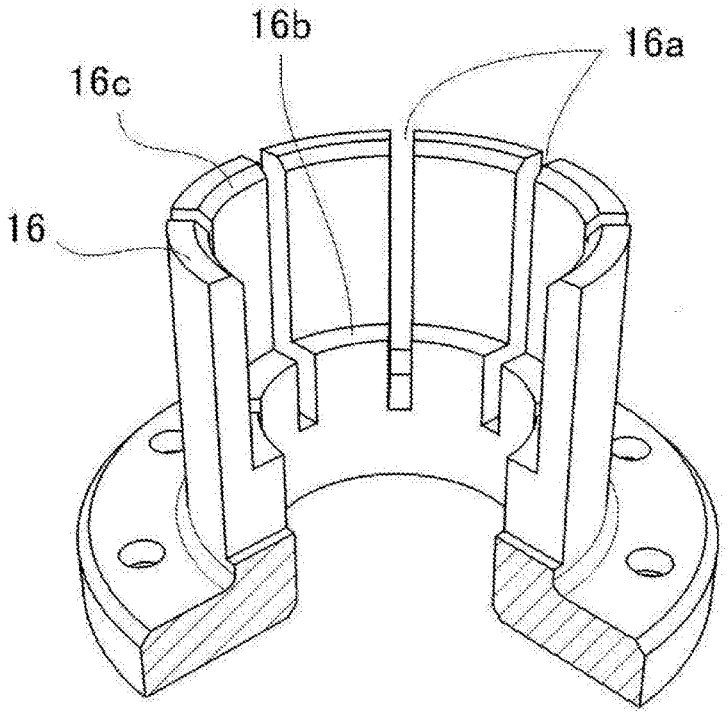
FIG. 11 is a perspective view showing a partial cross-section of a holder according to an embodiment of the present invention.
Figure 12:
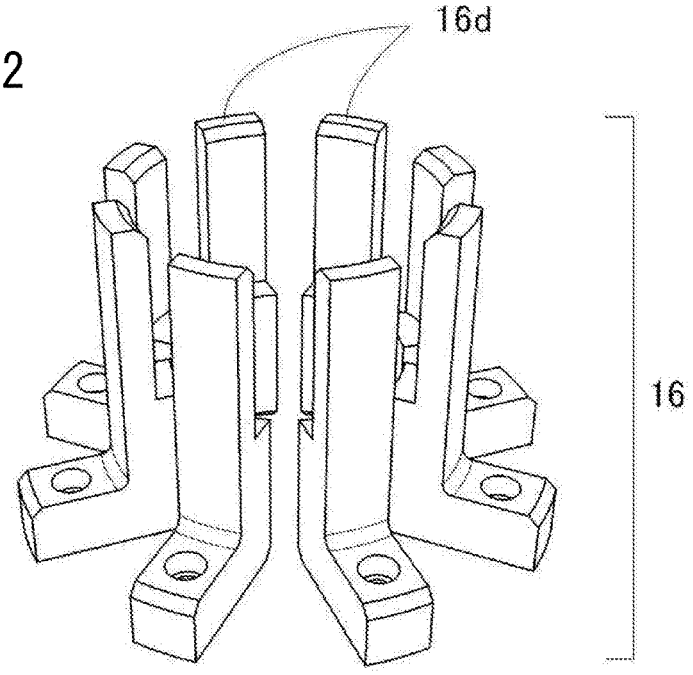
FIG. 12 is a perspective view showing a partial cross-section of a modification of the holder as shown in FIG. 11.

The holder 16 attached to the rotation table 91 detachably grips the melting container 2 and is disposed in the induction heating coil 15. The holder 16 is made of ceramic having excellent heat insulating property, has substantially a cylindrical shape, and is provided with at least one slit 16*a* as shown in FIG. 11. The lower side of a portion for gripping the melting container 2 is provided with a stepped portion 16*b* for preventing the melting container 2 from falling out, and the internal diameter of the stepped portion is larger than the external diameter of the moving rod 51 which penetrates through the holder 16 from the lower side to thereby allow pulling out the melting container 2 upward. Note that, in the same way as in the modification as shown in FIG. 12, the holder 16 can also be constituted by arranging a plurality of holder segments 16*c* concentrically, and graphite can also be used as the constituent material.

In FIG. 1, the moving rod 51 has a shape of pipe through which the plunger 50 penetrates, and is slidably fitted to the base plate 23. The space between the base plate 23 and the plunger 50 is vacuum-sealed for maintaining airtightness. The lower end of the moving rod 51 is fixed to a moving plate 24, and is lifted up and down by moving cylinders 42 and 43. Note that the external diameter of the moving rod 51 is smaller than that of the injection sleeve 3.

Figure 14:
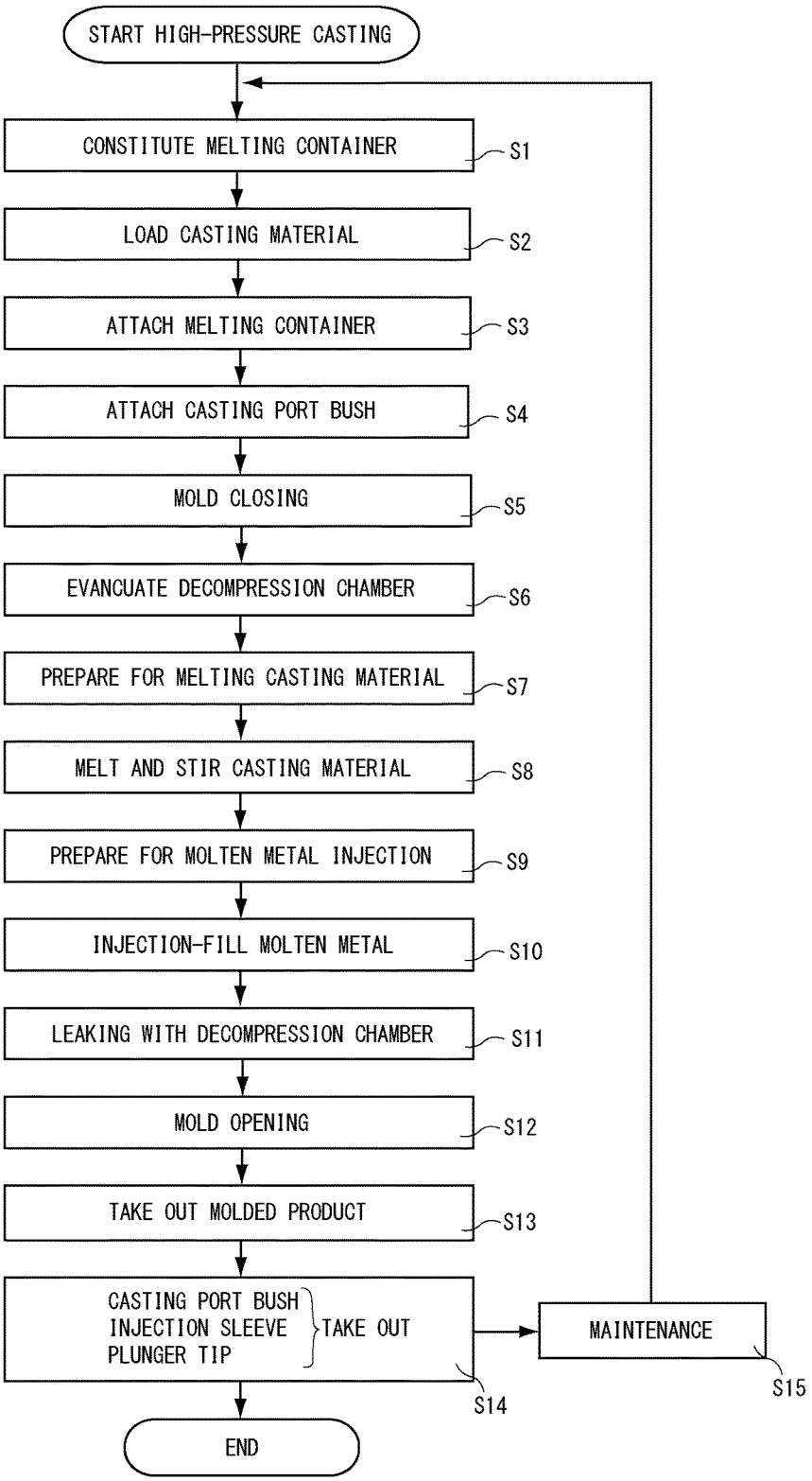
FIG. 14 is a flowchart of a high-pressure casting method according to an embodiment of the present invention.

Hereinafter, processes for executing the above configuration will be described referring to the drawings. FIG. 14 is a flowchart of the high-pressure casting method according to the embodiment of the present invention.

In step S1, the injection sleeve 3 and the plunger tip 4 constitute the melting container 2. Note that, as the injection sleeve 3 and the plunger tip 4 which constitute the melting counter 2, new ones or clean ones after completion of maintenance are used for each molding.

In step S2, the casting material 1 by the amount necessary for the single molding is loaded in the melting container 2, and in step S3, the melting container 2 is gripped by the holder 16 and is disposed in the induction heating coil 15.

In step S4, the casting port bush 13 is inserted from above the fixed mold 11 and is fitted to the fixed mold 11 and the guide 14, and in step S5, the movable die plate 22 is moved toward the fixed die plate 21 side by a mold closing cylinder 40 and closes the mold by bringing the movable mold 12 in contact with the fixed mold 11. At this time, the space around the mold is shielded from the outside air by the fixed housing 61 and the movable housing 62.

In step S6, the vacuum evacuation device 74 is used for evacuating an inside of the vacuum chamber 60 and the cavity 10 from the exhaust port 60*b* to thereby depressurize the inside of the vacuum chamber 60 to the predetermined pressure while measuring the pressure by using the vacuum gauge 73.

In step S7, the inclination motor 83 is driven for rotating the back plate 80 and is inclined so that the melting container is directed toward the radiation thermometer 75. The shielding motor 104 is used to rotate the shielding plate 100 until the plate is brought into contact with or substantially contact with the upper surface of the injection sleeve 3. Then, the inert gas is introduced from the gas introduction valve 72 and is jetted into the injection sleeve 3 from the nozzle 106.

In step S8, electric current is applied to the induction heating coil 15 to start heating the melting container 2 and the casting material 1, and at the time when the casting material 1 starts melting or at the time when the temperature of the casting material 1 measured by the radiation thermometer 75 reaches the fusion point, the rotation motor 96 is driven to rotate the melting container 2 around the center axis. The center axis of the melting container 2 is in a state of being inclined from the vertical direction in step S7, and thus the molten metal inside the container is stirred through forced convection only by rotating the melting container 2 in one direction at constant speed. However, reversing the rotating direction or change in the rotating speed may also be added. Furthermore, in a case where strong stirring is performed, the inclination operation by the inclination motor 83 is repeated while rotating the melting container 2 by the rotation motor 96, and thus the molten metal is oscillated through composite rotating operation.

Even after the temperature of the molten metal measured by the radiation thermometer 75 reaches a predetermined temperature, the molten metal is continuously stirred until the temperature of the molten metal becomes thermally uniformized as a whole. The melting state is confirmed from the view finder of the radiation thermometer 75, and in a case where the time required for ensuring a thermally uniformized state of the molten metal is known, the methods of stirring and heating the molten metal may be continued only for the period corresponding to the known heating time.

After the molten metal is thermally uniformized to a predetermined temperature, in step S9, the back plate 80 is reversely rotated to vertically stand the melting container 2, and then its rotation is stopped and heating by the induction heating coil 15 is completed. Immediately thereafter, the moving rod 51 is raised to pull out the melting container 2 upward from the holder 16 for replacement, and then the melting container 2 is communicated with the casting port bush 13, by guiding with the guide 14. At this time, the melting container 2 is brought into a close contact state with the guide 14 under its elastic recovery force.

The melting container 2 is rapidly cooled by holding the above-described state for a predetermined period of time, and thus the temperature boundary layer is formed near the molten metal in contact with the injection sleeve 3 inside the melting container 2. Accordingly, it becomes possible to suppress intrusion of the molten metal into the gap between the injection sleeve 3 and the plunger tip 4, or the casting port bush 13 and the plunger tip 4, and to thereby prevent reverse jetting. However, excessively long retention time may deteriorate fluidity of the molten metal, and may cause formation of the solidified layer, and thus it is necessary to set the retention time in accordance with the excessive heating temperature of the molten metal and the injection speed, by preliminary molding to be described later.

After retaining the molten metal in the melting container 2 only for the predetermined retention time, in step S10, the plunger 50 is brought into contact with the plunger tip 4 at a predetermined speed, and the molten metal in the melting container 2 is immediately transferred to the casting port bush 13 and is injection-filled into the cavity 10. Also after completion of filling, pressurization is performed by the plunger 50 for several seconds until the molten metal in the casting port bush 13 is completely solidified.

In step S11, the leak valve 71 is opened to return the vacuum chamber 60 to atmospheric pressure, and in step S12, the movable mold 12 is moved by the mold closing cylinder 40 to thereby open the mold.

In step S13, the molded product in the cavity 10 is taken out, and in step S14, the injection sleeve 3 and the casting port bush 13 in the guide 14 are extruded with the moving rod 51 upward of the fixed mold 11; and the injection sleeve 3, the casting port bush 13, and the plunger tip 4 are removed from the main body of the device.

In step S15, the injection sleeve 3, the casting port bush 13 and the plunger tip 4 which have been removed are transferred for maintenance work, and clean members after completion of the maintenance are used for the next molding.

The determination of the retention time by preliminary molding is carried out in the following way. The excessive heating temperature of the molten metal is set primarily, and the injection speed is gradually increased while setting the retention time to zero. The amount of the molten metal intruding into the gap between the casting port bush 13 and the plunger tip 4 is confirmed for each molding (confirmation is made in removing the casting port bush 13 and the plunger tip 4), and when the amount of the molten metal intruding into the gap increases, the retention time is gradually increased to thereby suppress an intrusion amount. When the intrusion amount is within the allowable range, the injection speed is gradually increased again within the retention time. This operation is repeated until the cavity 10 is completely filled, and repetitive adjustment is performed by the change of the excessive heating temperature of the molten metal as necessary, with the result that the retention time for ensuring prevention of the reverse jetting can be determined while maintaining fluidity of the molten metal as a whole.

It is possible to reliably prevent the reverse jetting without impairing the molten metal fluidity by performing preliminary molding like this, and thus it is possible to safely realize the thin-wall molding through high-speed injection even by using the active metal having a high fusion point such as titanium alloy and zirconium alloy.

Figure 13:
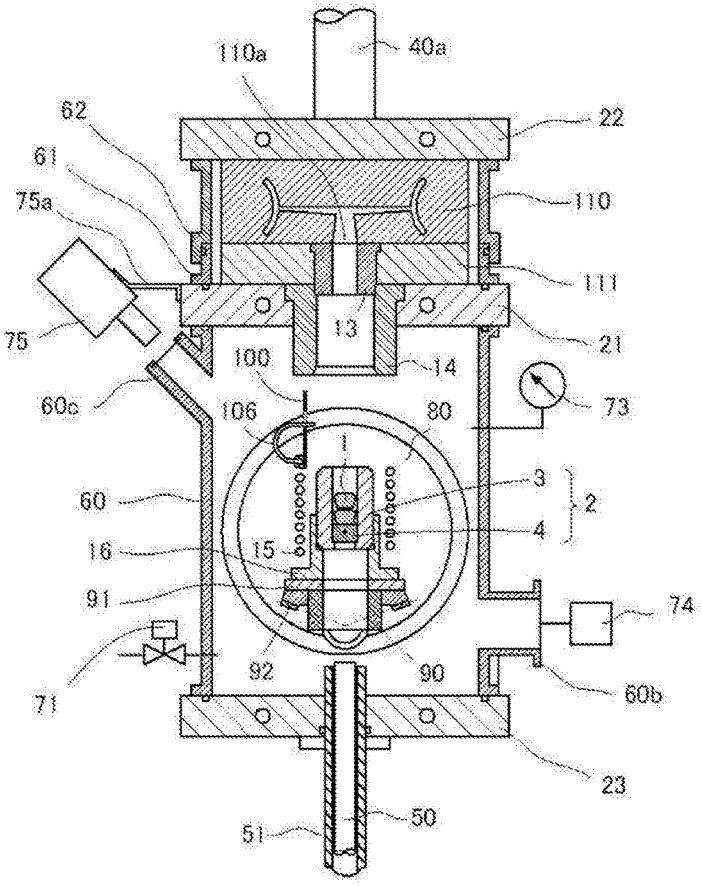
FIG. 13 is a front view showing a partial cross-section of a schematic configuration according to another embodiment of the present invention.

Furthermore, FIG. 13 is a schematic front view partially showing a cross section of the high-pressure casting device according to another embodiment of the present invention. In this embodiment, an integrated mold 110 manufactured through lost-wax casting and three-dimensional laminating molding method is available as the mold. A casting plate 111 which allows detachable mounting of the casting port bush 13 is attached to the fixed die plate 21. The integrated mold 110 is placed on the casting plate 111 by communicating a casting port 110*a* with the casting port bush 13, and is fixed by being pressed at the predetermined pressure via the movable die plate 22. Any other configurations are the same as those in the embodiment as shown in FIG. 1.

REFERENCE SIGNS LIST

1 casting material
2 melting container
3 injection sleeve
3*a* chamfering
3*b* chamfering
3*c* stepped portion
3*d* groove portion
4 plunger tip
5 retaining ring
10 cavity
11 fixed mold
12 movable mold
13 casting port bush
14 guide
14*a* slit
14*b* fitting portion
14*c* guide portion
14*d* tapered portion
14*e* flange portion
14*f* guide segment
14*g* cooling groove
14*h* cooling hole
14*i* O-ring
14*j* plug
15 induction heating coil
16 holder
16*a* slit
16*b* stepped portion
16*c* tapered portion
16*d* holder segment
17 insulation member
20 top plate
21 fixed die plate

21*a* cooling hole
22 movable die plate
22*a* cooling hole
23 base plate
23*a* cooling hole
24 moving plate
25 bottom plate
30 tie bar (tie rod)
31 tie bar
32 tie bar
40 mold closing cylinder
40*a* mold closing rod
41 injection cylinder
42 moving cylinder
43 moving cylinder
50 plunger
51 moving rod
60 vacuum chamber
60*a* hatch
60*b* exhaust port
60*c* view port
60*d* back port
61 fixed housing
62 movable housing
63 door
71 leak valve
72 gas introduction valve
73 vacuum gauge
74 vacuum evacuation device
75 radiation thermometer
75*a* radiation thermometer mount
80 back plate
81 sector gear
82 pinion gear
83 inclination motor
84 inclination motor mount
90 support arm
91 rotation table
92 large bevel gear
93 small bevel gear
94 rotation shaft
95 coupling
96 rotation motor
97 rotation motor mount
100 shielding plate
100*a* hole
101 shielding shaft
102 spur gear
103 pinion
104 shielding motor
105 shielding motor mount
106 nozzle
110 integrated mold
110*a* casting port
111 casting plate

The invention claimed is:

1. A high-pressure casting method for injection-filling of a molten metal pressurized with a plunger into a cavity, in which a melting container of cartridge type constitutes an injection sleeve detachably communicating with a casting port bush, and a plunger tip which is slidably fitted in the injection sleeve and is not fixed to the plunger, the method comprising;

after loading the melting container with a casting material, disposing the melting container in an induction heating coil and melting the casting material, in a state where the melting container is separated from the casting port bush and the plunger;

linearly moving the melting container so as to pass through an inside of a guide connected to the casting port bush to thereby be communicated therewith, and setting the melting container to a cooling state in close contact with the guide; and subsequently, bringing the plunger into contact with the plunger tip, immediately transferring the plunger into the casting port bush together with the molten metal, and then pressurizing the molten metal inside the casting port bush and injection-filling the molten metal into the cavity.

2. The high-pressure casting method according to claim 1, the method further comprising melting the casting material in a vacuum atmosphere or an inert atmosphere and injection-filling the molten metal into the cavity in a depressurized state.

3. The high-pressure casting method according to claim 1, the method further comprising removing the injection sleeve, the plunger tip, and the casting port bush from a main body of a device for each molding.

4. The high-pressure casting method according to claim 1, the method further comprising inclining the melting container to a vertical direction in melting of the casting material.

5. The high-pressure casting method according to claim 1, the method further comprising mechanically stirring the molten metal in the melting container in melting of the casting material.

6. A high-pressure casting device for injection-filling of a molten metal pressurized by a plunger into a cavity, comprising:

a cylindrical guide attached in a through-hole of a fixed die plate;

a casting port bush detachably connected to an upper portion of the guide;

an injection sleeve detachably communicating with a lower end of the casting port bush;

a plunger tip which is slidably fitted in the injection sleeve and is not fixed to the plunger;

a moving rod which linearly movies the injection sleeve so as to be detachably supported to pass through the guide, and communicates the injection sleeve with the lower end of the casting port bush;

an induction heating coil which is disposed in a movable range of the injection sleeve and which is for melting the casting material in the injection sleeve; and a holder capable of gripping the injection sleeve to be disposed in the induction heating coil, and capable of receiving and sending the injection sleeve from and to the moving rod, wherein the guide is set so as to be brought into a close contact state in a state where the injection sleeve communicates with the casting port bush.

7. The high-pressure casting device according to claim 6, further comprising a vacuum chamber which covers a space including the holder, communicates with the casting port bush on one side, and has, on the other side, the moving rod that is sildably inserted while shielding outside air.

8. The high-pressure casting device according to claim 6, wherein the moving rod operates so as to extrude and remove the casting port bush together with the injection sleeve.

9. The high-pressure casting device according to claim 6, further comprising an inclination mechanism for inclining the injection sleeve to a vertical direction.

10. The high-pressure casting device according to claim 6, further comprising a rotation mechanism for rotating the injection sleeve around its center axis.

11. The high-pressure casting device according to claim 6, further comprising a shielding mechanism for freely openably/closably covering a part of an upper opening portion of the injection sleeve.

12. The high-pressure casting device according to claim 6, further comprising a nozzle for jetting an inert gas toward an inside of the injection sleeve.

13. The high-pressure casting device according to claim 6, wherein the injection sleeve is made of graphite.

14. The high-pressure casting device according to claim 6, wherein the plunger tip is made of graphite.

* * * * *